US007980108B2

(12) United States Patent
Zuber

(10) Patent No.: US 7,980,108 B2
(45) Date of Patent: Jul. 19, 2011

(54) BENDING DEVICE FOR A TUBULAR MEMBER

(75) Inventor: Armin Zuber, Bad Lippspringe (DE)

(73) Assignee: Benteler Automobiltechnik GmbH, Paderborn (DE)

( * ) Notice: Subject to any disclaimer, the term of this patent is extended or adjusted under 35 U.S.C. 154(b) by 705 days.

(21) Appl. No.: 11/939,301

(22) Filed: Nov. 13, 2007

(65) Prior Publication Data

US 2008/0110223 A1 May 15, 2008

(30) Foreign Application Priority Data

Nov. 15, 2006 (DE) ..... 10 2006 054 119

(51) Int. Cl.
*B21D 7/02* (2006.01)

(52) U.S. Cl. ..... 72/149; 72/159

(58) Field of Classification Search ..... 72/148, 72/150, 154, 155, 157, 159
See application file for complete search history.

(56) References Cited

U.S. PATENT DOCUMENTS 1,238,941 A 9/1917 Reynders
3,118,488 A 1/1964 Barnhill et al.
4,563,891 A * 1/1986 Schwarze ..... 72/149
5,142,895 A * 9/1992 Schuchert ..... 72/150

FOREIGN PATENT DOCUMENTS

DE 201 18 444 U1 2/2002

* cited by examiner

*Primary Examiner* — Debra M Sullivan
(74) *Attorney, Agent, or Firm* — Henry M. Feiereisen; Ursula B. Day

(57) ABSTRACT

A bending device for a tubular member includes a bending tool which is rotatable about an axis. The bending tool includes a circumferential recess and is split transversely to the axis to form a first tool member and a second tool member. Extending tangentially to the recess and partly embracing the tubular member is a plate-shaped wiper die which has a receiving channel. A non-rotatable disc-shaped support tab is securely fixed to the wiper die and projects between the first and second tool members. The support tab has a circumferential cradle which is configured to match a contour of the tubular member and to merge into the receiving channel of the wiper die in a tangential and smooth manner. An outer clamping jaw is jointly pivotable with the bending tool, and a trough-shaped resistance member is placed in opposition to the wiper die and movable longitudinally along the receiving channel.

7 Claims, 4 Drawing Sheets

BENDING DEVICE FOR A TUBULAR MEMBER

CROSS-REFERENCES TO RELATED APPLICATIONS

This application claims the priority of German Patent Application, Serial No. 10 2006 054 119.7, filed Nov. 15, 2006, pursuant to 35 U.S.C. 119(a)-(d), the content of which is incorporated herein by reference in its entirety as if fully set forth herein.

BACKGROUND OF THE INVENTION

The present invention relates, in general, to a bending device for tubular pipes or like members.

Nothing in the following discussion of the state of the art is to be construed as an admission of prior art.

German utility model no. DE 201 18 444 U1 describes a bending device having a bending tool to bend a tubular member. As the inner region of the tubular member to be bent is exposed to significant pressure stress, there is a tendency in the tube wall to form wrinkles. In order to prevent wrinkling in the surface of the tubular member, a wiper die is positioned near the bending tool. As a result, wrinkling can be avoided so long as the wiper die is correctly positioned relative to the bending tool. The wiper die has hereby a receiving channel which merged tangentially into a circumferential recess of the bending tool. The presence of just a small unevenness or air gap between the bending tool and the wiper die is however sufficient to cause wrinkling and furrows, thereby considerably impairing the quality of the bent tubular member. The wiper die is also adjustably constructed to account for wear during use. Still, the wiper die must be completely replaced when worn out and undertaking a certain number of bending processes.

It would be desirable and advantageous to provide an improved bending device to obviate prior art shortcomings.

SUMMARY OF THE INVENTION

According to one aspect of the present invention, a bending device for a tubular member includes a bending tool rotatable about an axis, with the bending tool including a circumferential recess and being split transversely to the axis to form a first tool member and a second tool member, a plate-shaped wiper die having a receiving channel extending tangentially to the recess and partly embracing the tubular member, a non-rotatable disc-shaped support tab securely fixed to the wiper die and projecting between the first and second tool members, with the support tab having a circumferential cradle configured to match a contour of the tubular member and to merge into the receiving channel of the wiper die in a tangential and smooth manner, an outer clamping jaw jointly pivotable with the bending tool, and a trough-shaped resistance member placed in opposition to the wiper die and movable longitudinally along the receiving channel.

As a result of a bending device according to the invention, unevenness and air gaps are positively prevented in those circumferential regions of the tubular member to be bent that are at highest risk. The structure comprised of wiper die and support tab is exposed to minimal friction wear only and thus has a long service life. Repositioning of the wiper die during continuous use is no longer required, and readjustment is also no longer needed in view of the effectively unitary structure of wiper die and support tab. The resistance member in opposition to the wiper die is able to guide the tubular member during the bending process and to minimize stretching strain of the tube wall. In addition, the resistance member may be used as guide element for a mandrel that is inserted in the tubular member.

According to another feature of the present invention, the wiper die and the support tab may be made in one piece.

According to another feature of the present invention, an inner clamping jaw may be exchangeably supported in segmental openings of the first and second tool members.

According to another feature of the present invention, the outer clamping jaw may have lateral legs for embracing the inner clamping jaw in a U-shaped manner. This improves stability.

Taking into account the forces to which the tool members and the clamping jaws are subjected, the stability of the bending tool can be further improved by providing a conical tension member which holds the first and second tool members and the inner and outer clamping jaws in the required position.

According to another feature of the present invention, the first and second tool members are supported on the support tab in such a way that the first and second tool members are mounted to a shaft which is distanced from neckings on the support tab by means of a rolling-contact bearing unit such as a cone bearing.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
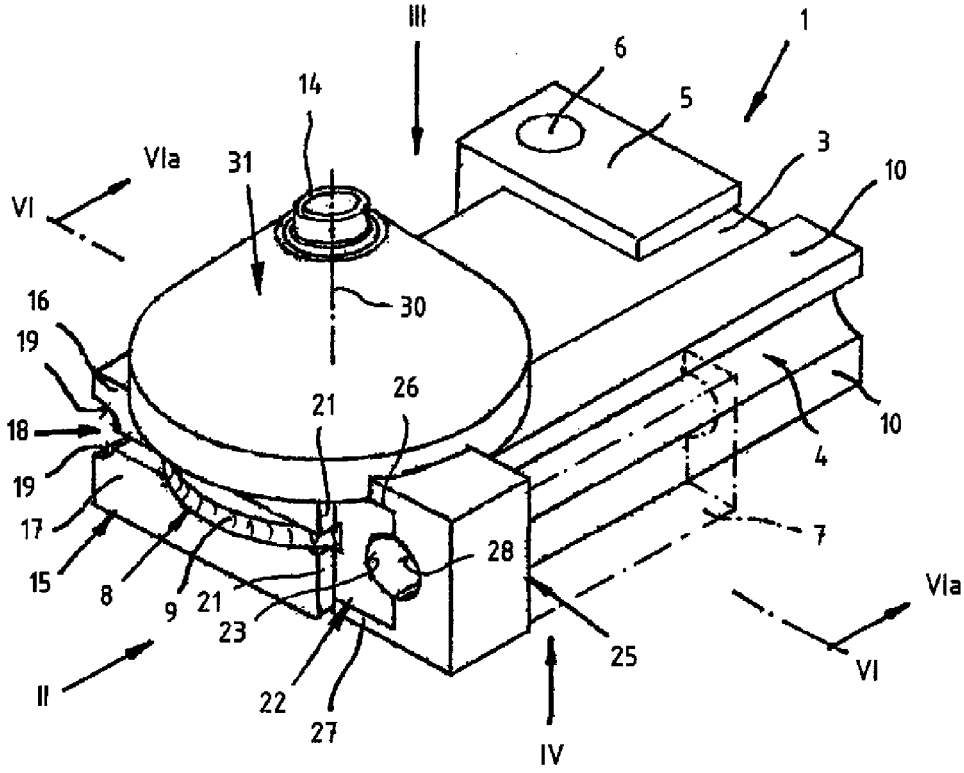
FIG. 1 is a perspective view of a bending device according to the present invention for bending a tubular member.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 3:
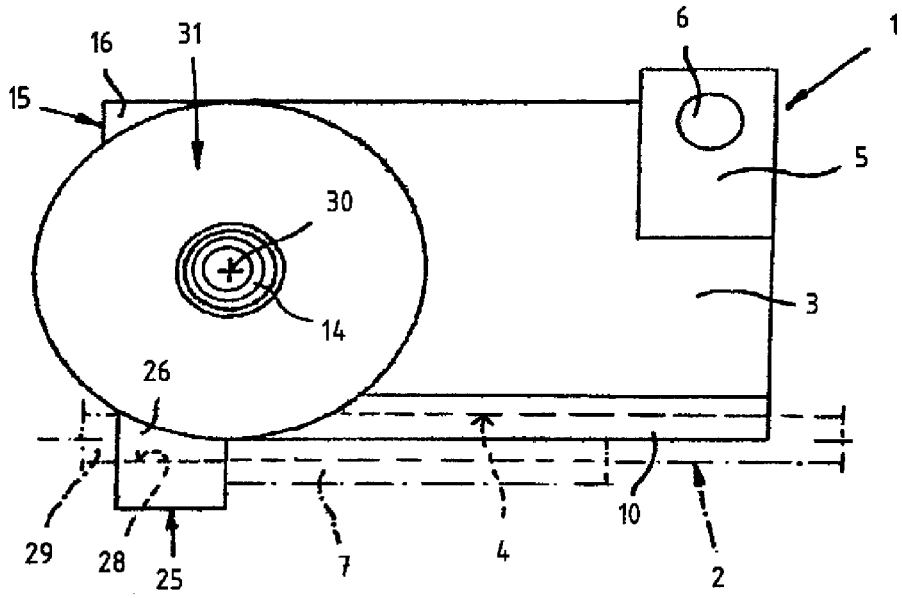
FIG. 3 is top view of the bending device in a direction of arrow III in FIG. 1.

Turning now to the drawing, and in particular to FIG. 1, there is shown a perspective view of a bending device according to the present invention, generally designated by reference numeral 1, for bending a tubular member 2, shown by way of example in FIG. 3. The bending device 1 includes a plate-shaped wiper die 3 formed with a receiving channel 4 which partly embraces the tubular member 2 and has reinforced lateral walls 10. The wiper die 3 has a thickened region 5 formed with a bore 6 for accepting a shaft, not shown in detail. Coupled to the wiper die 3 is a trough-shaped resistance member 7 which is movable longitudinally in a direction of the receiving channel 4.

Figure 4:
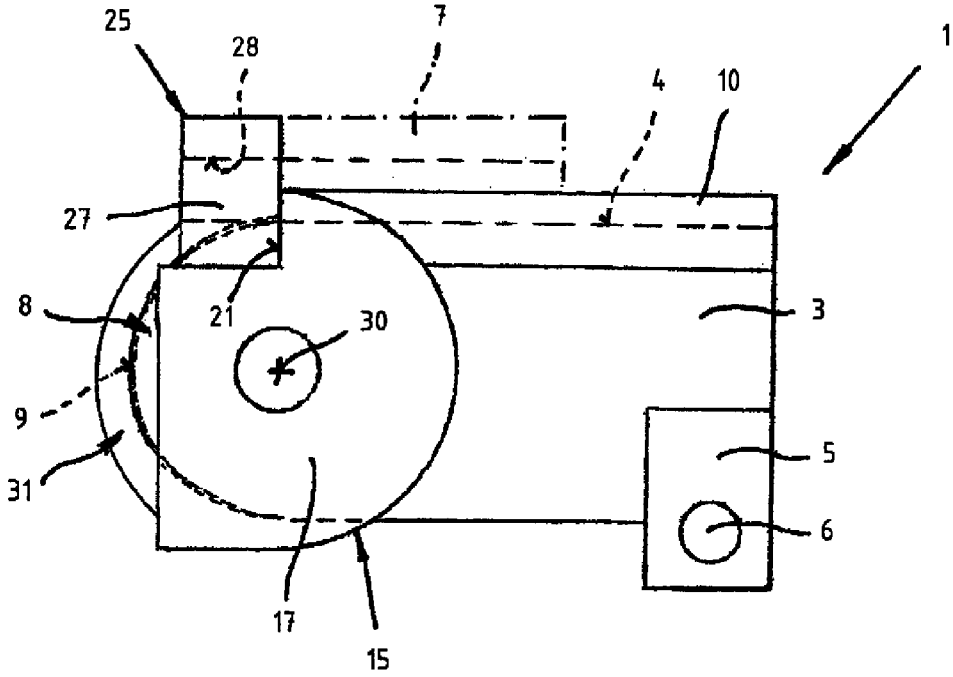
FIG. 4 is a bottom view of the bending device in a direction of arrow IV in FIG. 1.
Figure 5:
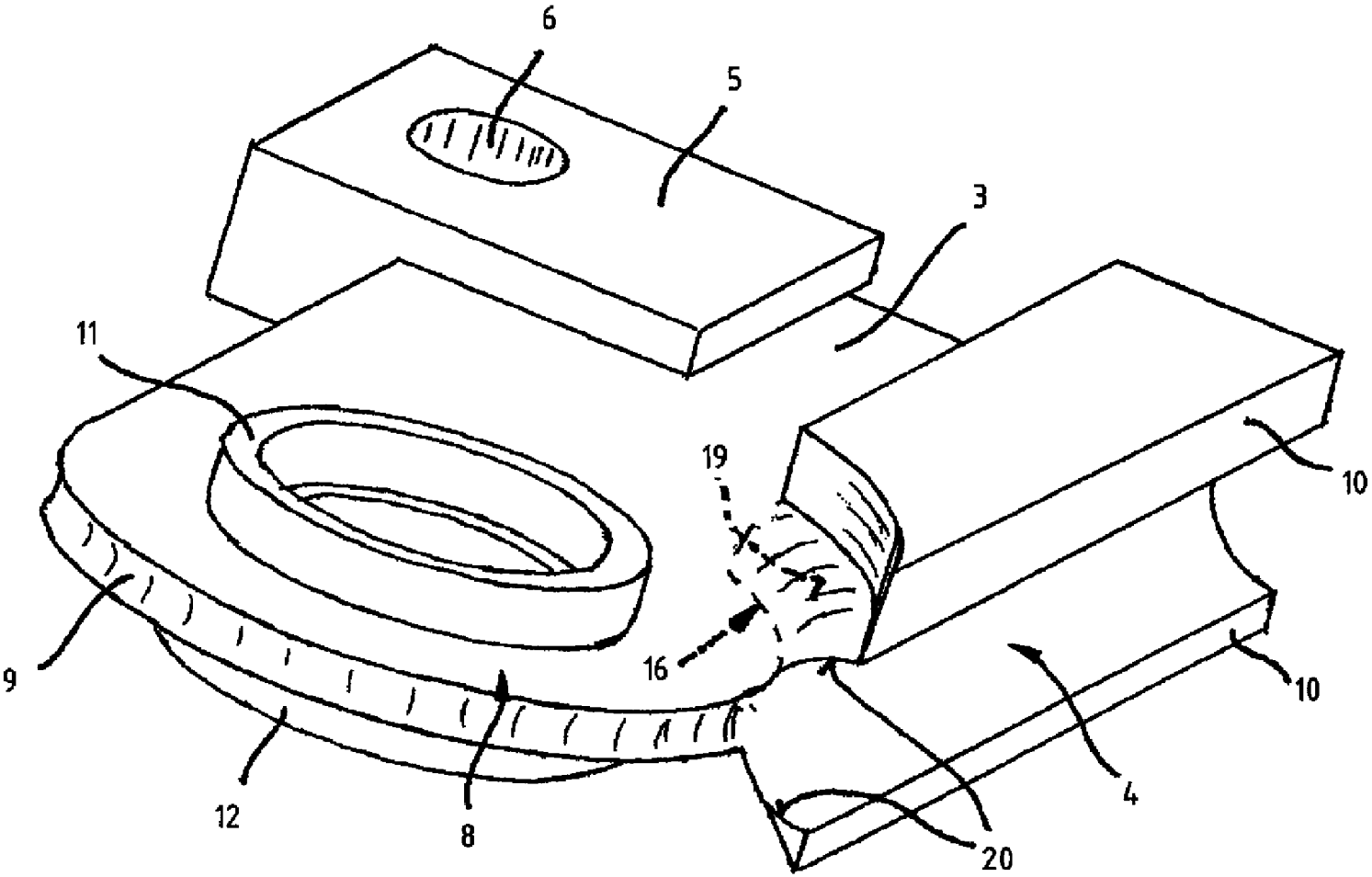
FIG. 5 is a perspective view of a detail of the bending device.

As shown in particular in FIG. 5, the wiper die 3 merges at its end distal to the thickened region 5 into a disc-shaped support tab 8. The support tab 8 is formed with a circumferential cradle 9 configured to match the contour of the tubular member 2. The cradle 9 extends in a tangential and smooth manner in the absence of any projections to the receiving channel 4 of the wiper die 3, as also shown in FIG. 4.

Figure 2:
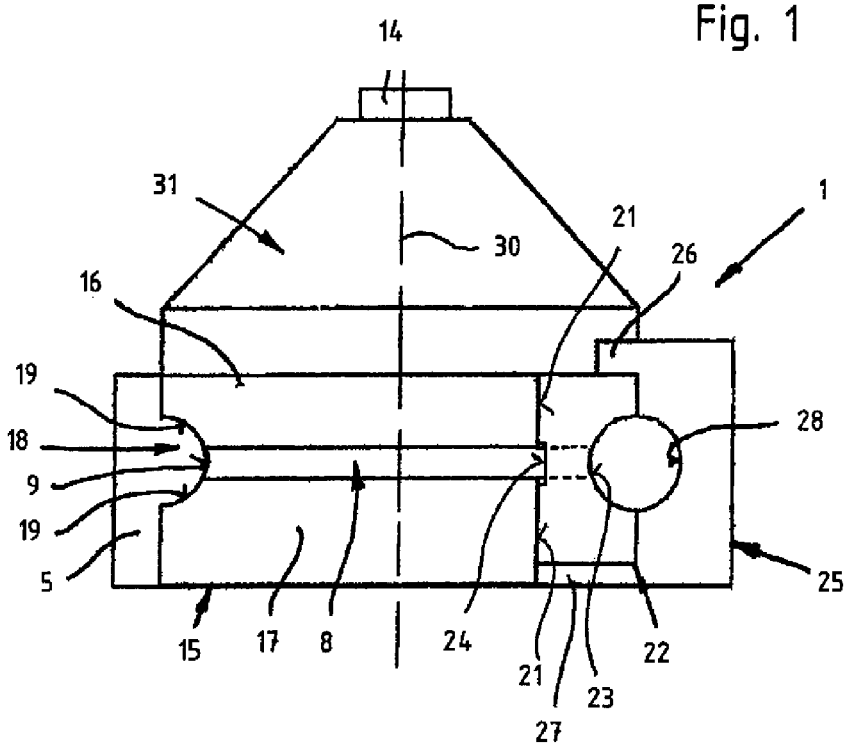
FIG. 2 is an end view of the bending device in a direction of arrow II in FIG. 1.
Figure 6:
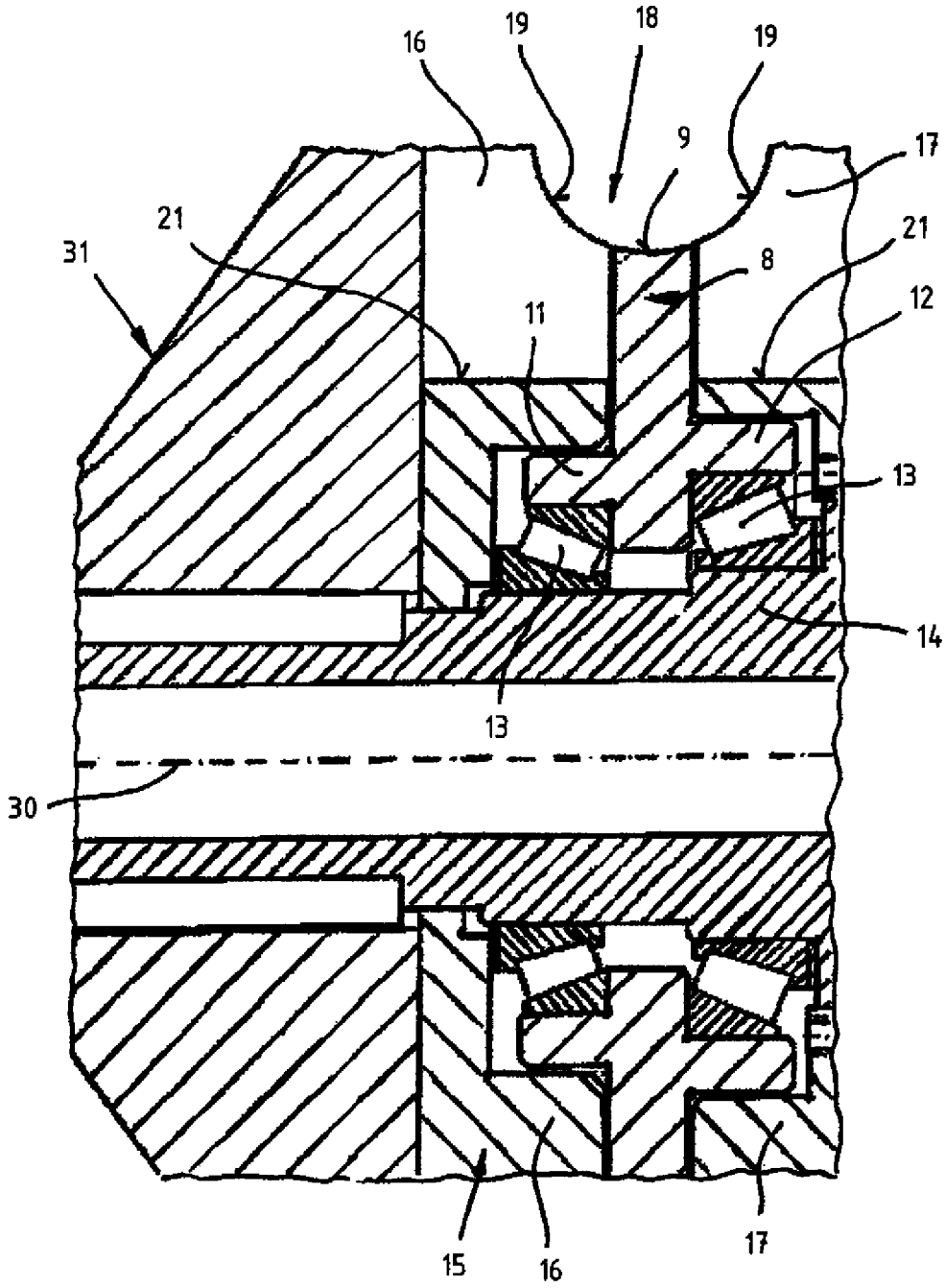
FIG. 6 is a partly sectional view of the bending device, taken along the line VI-Vi in FIG. 1, as viewed in a direction of arrows Via.

As shown in FIGS. 5 and 6, the support tab 8 is provided on both sides thereof with a necking 11, 12 to provide for a rotatable positioning of a bending tool 15. The neckings 11, 12 are hereby supported on a hollow bending shaft 14 through intervention of a rolling-contact bearing unit, e.g. cone bearings 13. The bending tool 15 is best shown in FIGS. 1, 2, and 6 and includes a first tool member 16 and a second tool member 17 which are secured onto the bending shaft 14. The drive for the bending tool 15 is not shown in greater detail for the sake of simplicity.

The bending tool 15 includes a circumferential recess 18 (FIGS. 1, 2, and 6) formed to match the contour of the tubular member 2. The recess 18 includes shell-shaped channels 19 in the first and second tool members 16, 17. As indicated in FIG. 5, the lateral regions 20 of the receiving channel 4 of the wiper die 3 are positioned immediately adjacent to the channels 19. Part of these channels 19 is shown with respect to the first tool member 16. FIG. 2 also shows that the channels 19 together with the cradle 9 in the support tab 8 are configured to match the contour of the receiving channel 4.

An inner clamping jaw 22 is replaceably supported in segmental openings 21 of the first and second tool members 16, 17, as shown in FIGS. 1, 2, and 4. Formed in the inner clamping jaw 22 is a shell 23 configured to match the contour of the tubular member 2. The inner clamping jaw 22 is further provided with a recess 24 at a location distal to the shell 23 for engagement of the support tab 8. An outer clamping jaw 25 has lateral legs 26, 27 to embrace the inner clamping jaw 22 in a U-shaped manner. The outer clamping jaw 25 is formed with a cradle 28 configured to match the contour of the tubular member 2. As shown in FIG. 3, an end of the tubular member 2 can be clamped by means of the inner and outer clamping jaws 22, 25, and the tubular member 2 can then be bent by the bending tool 15 which rotates about an axis 30. As a result, the tubular member 2 is in close contact in the recess 18 formed by the cradle 9 in the support tab 8 and the channels 19 in the first and second tool members.

A conical tension member 31 is secured to the bending shaft 14 in order to ensure the required position of the outer and inner clamping jaws 25, 22 and of both tool members 16, 17 during the bending process.

While the invention has been illustrated and described in connection with currently preferred embodiments shown and described in detail, it is not intended to be limited to the details shown since various modifications and structural changes may be made without departing in any way from the spirit of the present invention. The embodiments were chosen and described in order to best explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A bending device for a tubular member, comprising:

a bending tool rotatable about an axis, said bending tool including a circumferential recess and being split transversely to the axis to form a first tool member and a second tool member, said recess including shell-shaped channels in the first and second tool members;

a plate-shaped wiper die having a receiving channel extending tangentially to the recess and sized to embrace a major part of the tubular member;

a non-rotatable disc-shaped support tab securely fixed to the wiper die and projecting between the first and second tool members, said support tab having a circumferential cradle configured to merge into the receiving channel of the wiper die in a tangential and smooth manner;

an outer clamping jaw jointly pivotable with the bending tool; and a trough-shaped resistance member placed in opposition to the wiper die and movable longitudinally along the receiving channel, wherein the channels of the recess of the bending tool together with the cradle in the support tab are configured to match a contour of the receiving channel, and wherein the receiving channel has reinforced lateral walls which end in lateral regions positioned immediately adjacent to the channels to merge into the channels.

2. The bending device of claim 1, wherein the wiper die and the support tab are made of single-piece construction.

3. The bending device of claim 1, further comprising an inner clamping jaw exchangeably supported in segmental openings of the first and second tool members.

4. The bending device of claim 3, wherein the outer clamping jaw has lateral legs for embracing the inner clamping jaw in a U-shaped manner.

5. The bending device of claim 3, further comprising a conical tension member for positioning the first and second tool members and the inner and outer clamping jaws.

6. The bending device of claim 1, wherein the support tab has lateral neckings, and further comprising a shaft on which the first and second tool members are mounted, and a rolling-contact bearing unit for distancing the shaft in relation to the neckings.

7. The bending device of claim 6, wherein the rolling-contact bearing unit is a cone bearing.

* * * * *